US008286302B2

(12) United States Patent
Andrup et al.

(10) Patent No.: US 8,286,302 B2
(45) Date of Patent: Oct. 16, 2012

(54) UPRIGHT VACUUM CLEANER

(75) Inventors: Klemens Andrup, Verl (DE); Udo Mersmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1085 days.

(21) Appl. No.: 12/199,159

(22) Filed: Aug. 27, 2008

(65) Prior Publication Data

US 2009/0056061 A1 Mar. 5, 2009

(30) Foreign Application Priority Data

Aug. 30, 2007 (DE) ..... 10 2007 040 957

(51) Int. Cl.
*A47L 5/32* (2006.01)

(52) U.S. Cl. ..... 15/331; 15/334; 15/335; 15/410

(58) Field of Classification Search ..... 15/331, 15/334, 335, 410; *A47L 5/32*
See application file for complete search history.

(56) References Cited

U.S. PATENT DOCUMENTS

| | | | | |
|---|---|---|---|---|
| 4,761,850 | A | 8/1988 | Romeo et al. | |
| 5,331,715 | A | 7/1994 | Johnson et al. | |
| 5,477,586 | A | 12/1995 | Jacobs et al. | |
| 6,108,861 | A | 8/2000 | Vystrcil et al. | |
| 6,260,233 | B1 | 7/2001 | Wareham et al. | |
| 6,572,078 | B1 * | 6/2003 | Thomson et al. | 251/162 |
| 7,650,668 | B2 | 1/2010 | Kim | |
| 2003/0051307 | A1 | 3/2003 | Hashizume et al. | |
| 2003/0226228 | A1 | 12/2003 | Symensma et al. | |
| 2005/0210627 | A1 | 9/2005 | Luebbering et al. | |
| 2006/0042043 | A1 | 3/2006 | Kim | |
| 2006/0070203 | A1 | 4/2006 | Fischer | |
| 2006/0070204 | A1 | 4/2006 | Blocker et al. | |
| 2007/0094838 | A1 | 5/2007 | Zahuranec et al. | |
| 2007/0209147 | A1 | 9/2007 | Krebs et al. | |

(Continued)

FOREIGN PATENT DOCUMENTS

EP 0708613 A1 5/1996

(Continued)

OTHER PUBLICATIONS

European Search Report for EP 08 01 4880, dated Jul. 13, 2011.

(Continued)

*Primary Examiner* — David Redding
(74) *Attorney, Agent, or Firm* — Leydig, Voit & Mayer, Ltd.

(57) ABSTRACT

An upright vacuum cleaner for cleaning a surface includes a base unit, a carriage configured to move the base unit on the surface, and an upper body having a dust collection container disposed therein. The upper body is supported so as to be tiltable relative to the base unit and is lockable in a parked position in which the vacuum cleaner has a substantially upright position when standing on the surface. A motor-fan unit is configured to provide a partial vacuum at the surface. An air conduit connecting the base unit and the dust collection container includes an interface and a section formed by a hose or an assembly of the hose and a wand. The section is connected downstream of the interface and is disposed at least partially externally on the upper body. The section is configured to enable a vacuuming mode of operation that is independent of the base unit. A tubular member forming at least part of a transition between the hose and the upper body. The tubular member is swivelably disposed on the upper body.

11 Claims, 7 Drawing Sheets

U.S. PATENT DOCUMENTS

| | | | |
|---|---|---|---|
| 2009/0056054 | A1 | 3/2009 | Hanschur et al. |
| 2009/0056055 | A1 | 3/2009 | Andrup et al. |

FOREIGN PATENT DOCUMENTS

| | | | |
|---|---|---|---|
| GB | 373072 | A | 5/1932 |
| GB | 1394497 | A | 5/1975 |
| GB | 2291336 | A | 1/1996 |
| GB | 2349069 | A | 10/2000 |
| GB | 2350553 | A | 12/2000 |
| NL | 7305557 | A | 10/1973 |
| WO | WO 2005/110178 | A1 | 11/2005 |
| WO | WO 2006/015309 | A2 | 2/2006 |
| WO | WO-2007008770 | A2 | 1/2007 |

OTHER PUBLICATIONS

European Patent Office, Europen Search Report in European Patent Application No. 08014482 (Dec. 22, 2009).

* cited by examiner

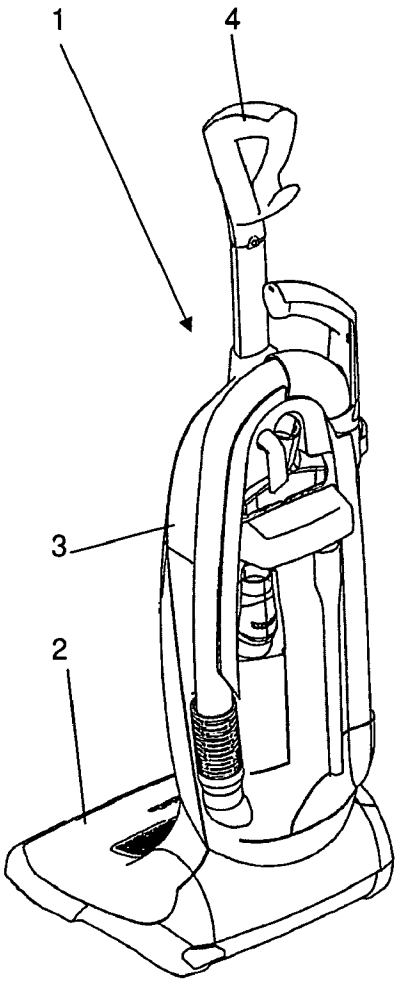
Fig. 3
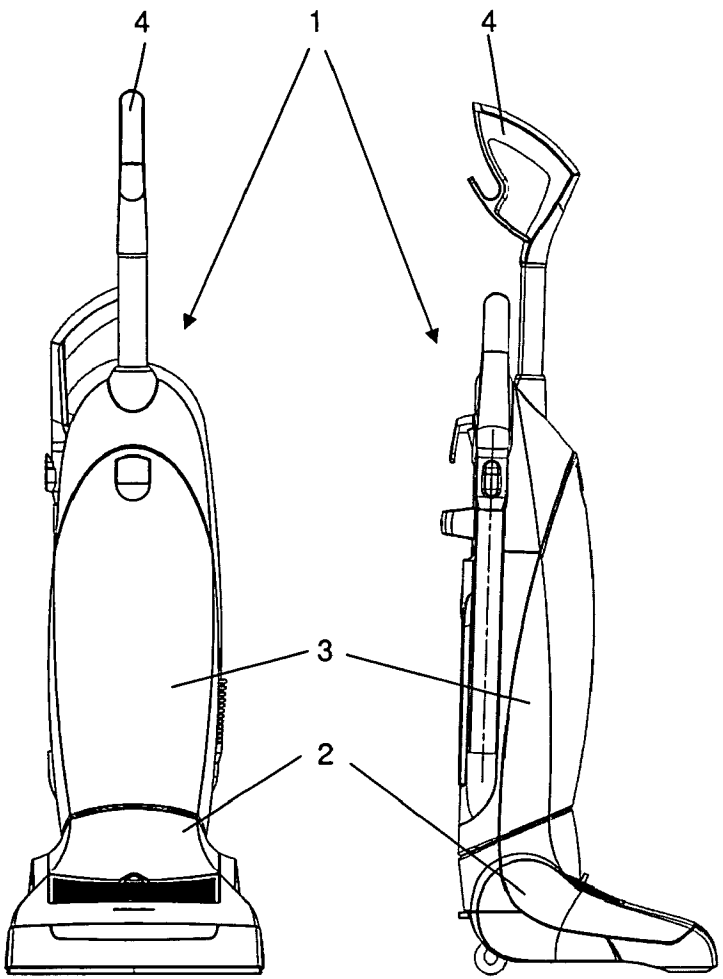
Fig. 2
Fig. 1

UPRIGHT VACUUM CLEANER

CROSS REFERENCE TO RELATED APPLICATIONS

Priority is claimed to German Patent Application No. DE 10 2007 040 957.7, filed Aug. 30, 2007, which is hereby incorporated by reference herein.

FIELD

The present invention relates to a vacuum cleaner of the upright type, including an upper body containing a dust collection container, a base unit, a carriage permitting said base unit to move on the surface to be cleaned and an air conduit leading from the base unit to the dust collection container.

BACKGROUND

The following is a description of three types of vacuum cleaners which differ in design and operation. All of them have, as common features, a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts are tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. In order to give the user additional options for vacuuming besides vacuum cleaning with the base unit, such as above-the-floor-vacuuming, the air conduit has an interface and, downstream thereof, a section which is formed by a hose or hose/wand assembly. In most designs, a wand member is held in an insertion receptacle. After removing the wand member from the insertion receptacle, different types of vacuum attachments may be attached to the suction end thereof. The assembly so formed can be used in the same manner as with a conventional canister vacuum cleaner. The aforementioned assembly uses a relatively long hose to provide adequate reach for the user (see, for example, WO 2007/008770 A1). The hose can also be flexible and extensible in length. In situations where the hose is still not long enough, the user tends to pull on the hose to cause the upright in the parked position to move off on its carriage and follow him/her. If the point of transition from the hose to the upper body, and thus the point of application of the pulling force, is located at a relatively high position, such as is described in WO 2007/008770 A1, then a moment is generated about the tip-over point, for example the two rear wheels. The upright will then tip over and may be damaged. In the vacuum cleaner described in EP 0 708 613 B1, this problem is avoided by routing the hose directly into the corresponding housing part at a very low position. As a result, the hose may kink when pulled on sideways, and in addition, the hose is easily damaged by contact with obstacles in the proximity of the floor.

SUMMARY

An aspect of the present invention is to provide an upright vacuum cleaner in which the hose is protected while at the same time ensuring vertical stability.

In an embodiment, the present invention provides an upright vacuum cleaner for cleaning a surface including a base unit, a carriage configured to move the base unit on the surface, and an upper body having a dust collection container disposed therein. The upper body is supported so as to be tiltable relative to the base unit and is lockable in a parked position in which the vacuum cleaner has a substantially upright position when standing on the surface. A motor-fan unit is configured to provide a partial vacuum at the surface. An air conduit connecting the base unit and the dust collection container includes an interface and a section formed by a hose or an assembly of the hose and a wand. The section is connected downstream of the interface and is disposed at least partially externally on the upper body. The section is configured to enable a vacuuming mode of operation that is independent of the base unit. A tubular member forming at least part of a transition between the hose and the upper body. The tubular member is swivelably disposed on the upper body.

BRIEF DESCRIPTION OF THE DRAWINGS

An exemplary embodiment of the present invention will be described in more detail below and is schematically shown in the drawings, in which:

FIGS. 1 through 6 show various overall views of the vacuum cleaner of the present invention;

DETAILED DESCRIPTION

In an embodiment, the present invention provides a vacuum cleaner of the upright type, including an upper body containing a dust collection container, a base unit and a carriage permitting said base unit to move on the surface to be cleaned; the upper body being supported such that it is at least tiltable relative to the base unit and capable of being locked in a parked position in which the vacuum cleaner assumes a substantially upright position when standing on the surface to be cleaned; the vacuum cleaner further including a motor-fan unit for creating a partial vacuum to act on the surface to be cleaned, and an air conduit leading from the base unit to the dust collection container, said air conduit having an interface and including a section which is formed by a hose or hose/wand assembly and is located downstream of said interface and which enables a vacuuming mode of operation which is independent of the base unit.

The upright vacuum cleaner shown in different views in FIGS. 1 through 6 (hereinafter abbreviated as upright 1) includes a base unit 2, an upper body 3, and a joint disposed therebetween, which will be described in greater detail further on in this specification.

Figure 4:
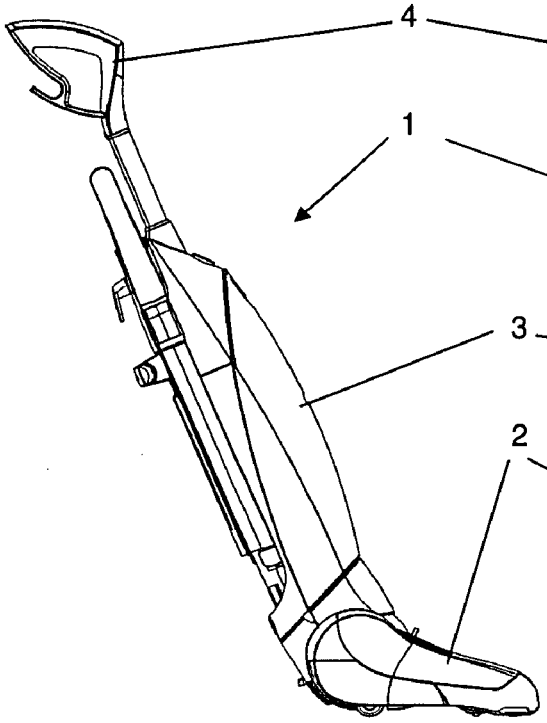
Figure 5:
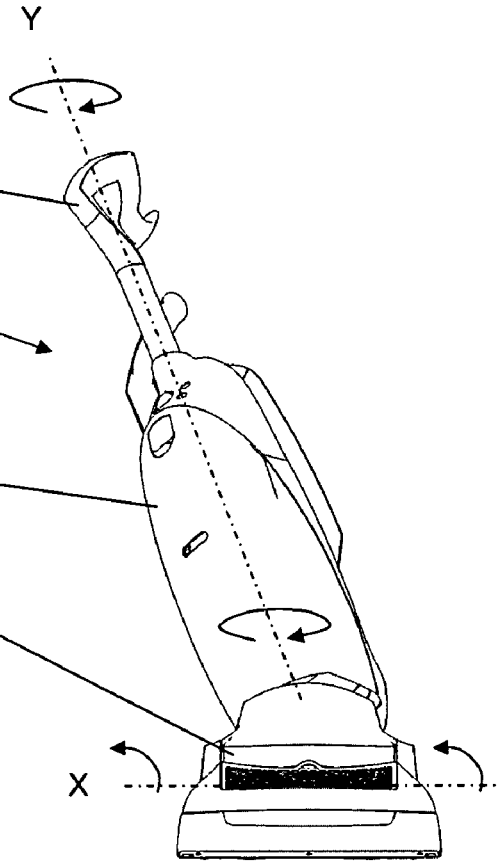
Figure 6:
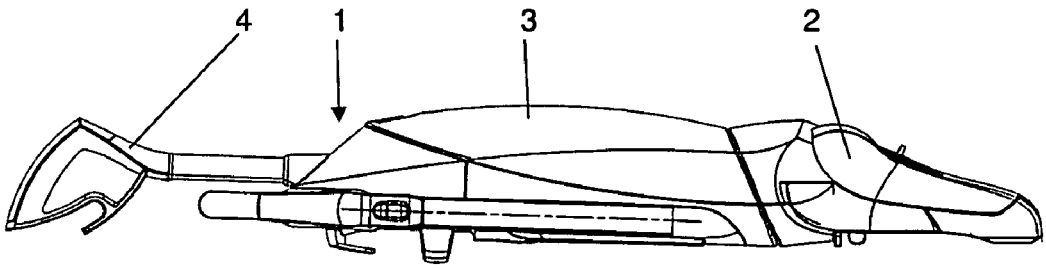
Figure 7:
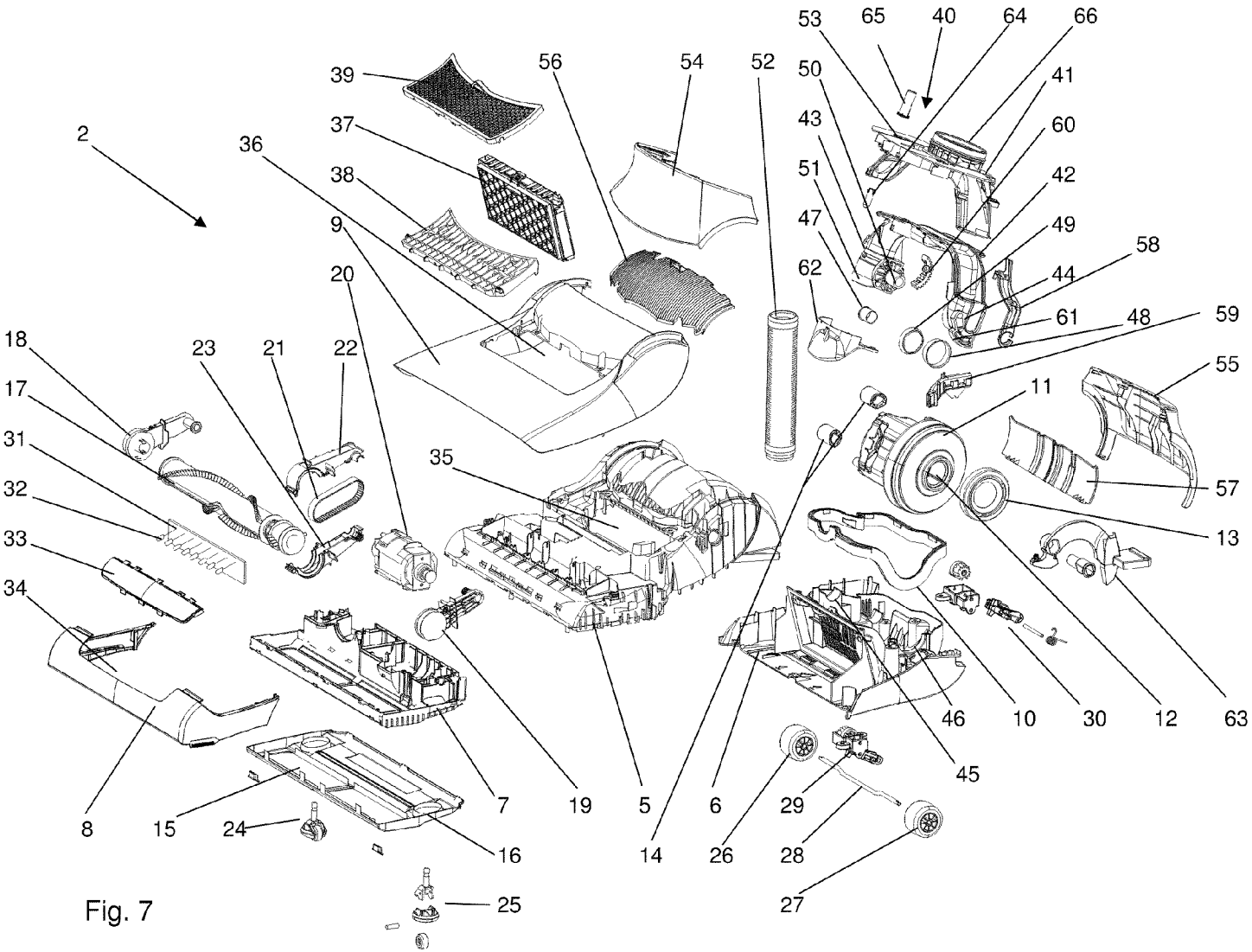
FIG. 7 is an exploded view showing the base unit of the vacuum cleaner.

Upright 1 can be brought from an upright position (see FIGS. 1 through 3), in which it can be locked and stand unsupported, to a tilted position (FIGS. 4 and 5), or even to a fully flat position (FIG. 6), after the locked engagement has been released (see FIG. 7). To this end, base unit 2 and upper body 3 are connected in such a manner that they can be tilted relative to each other about an axis X extending horizontally in a position of use (see FIG. 5). This pivoting movement is made possible by a joint which is hereinafter referred to as "tilting joint". In the tilted position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as "swivel joint".

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, namely an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable (not shown) is secured to bridge portion 53. To enable the upright to be locked in the upright position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 8:
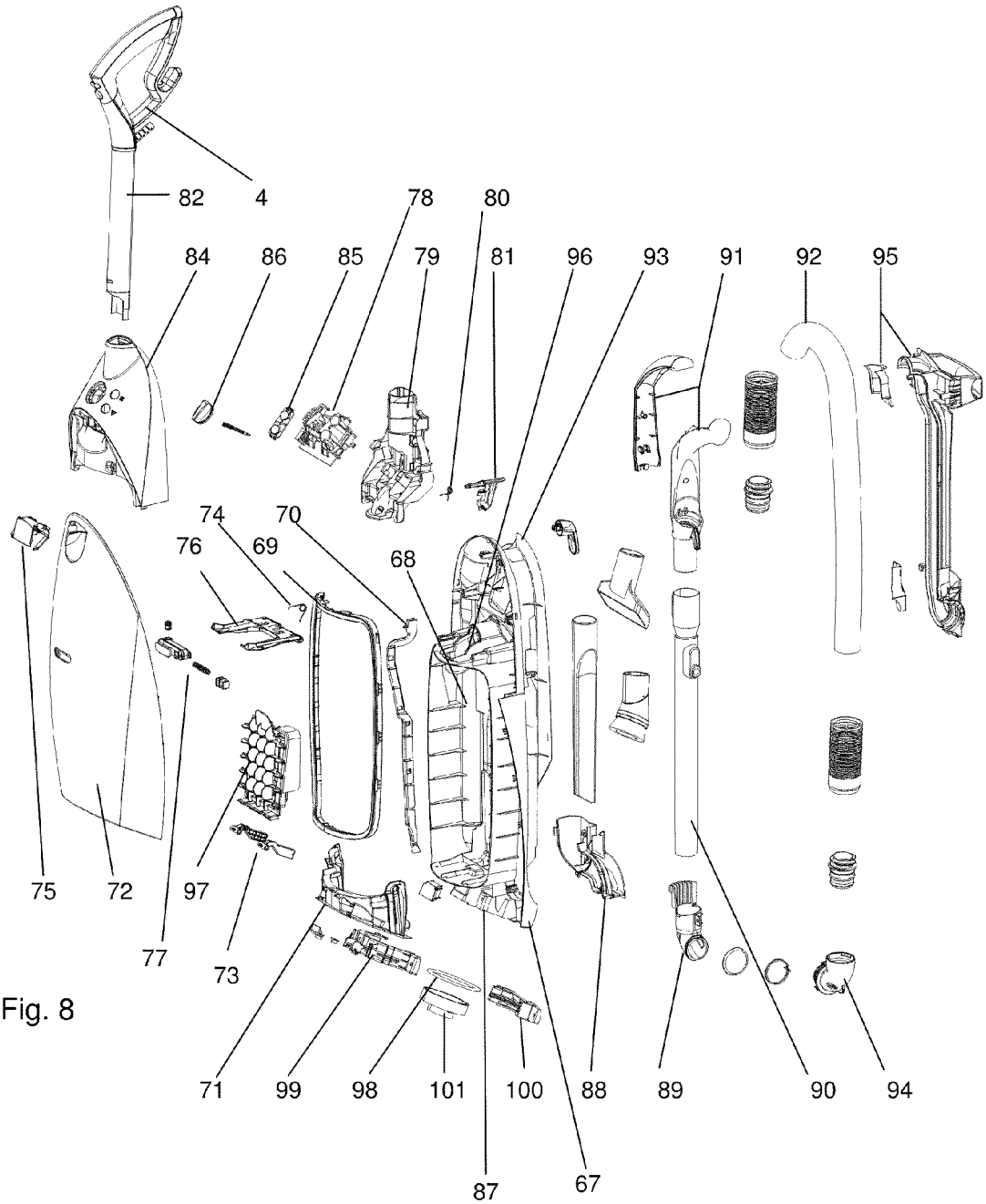
FIG. 8 is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of a dust chamber 68, which in turn receives a dust collection container in the form of a filter bag (not shown in the drawing). A seal 69 surrounds the edge of dust chamber 68, and a covering strip 70 for cables (not shown) is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

Figure 10:
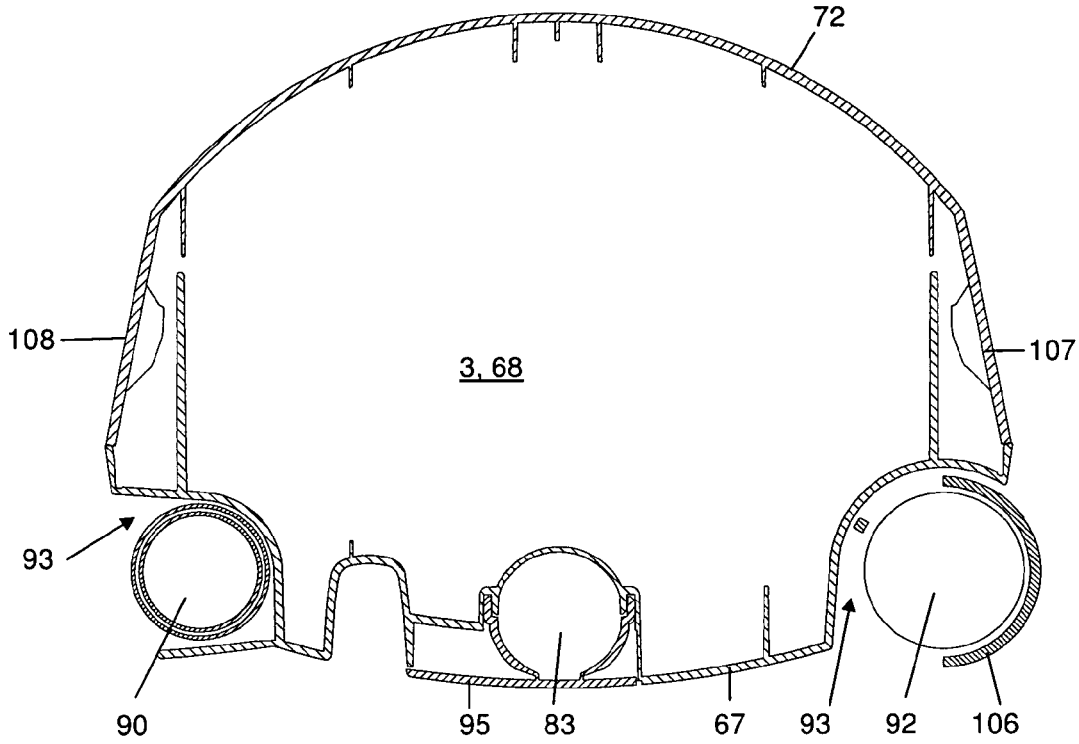
FIG. 10 is a cross-section through the upper body in the transition region from the hose to the upper body.

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct 83 (see FIG. 10) which extends along the entire length of rear wall 67. Duct 83 is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

Figure 9:
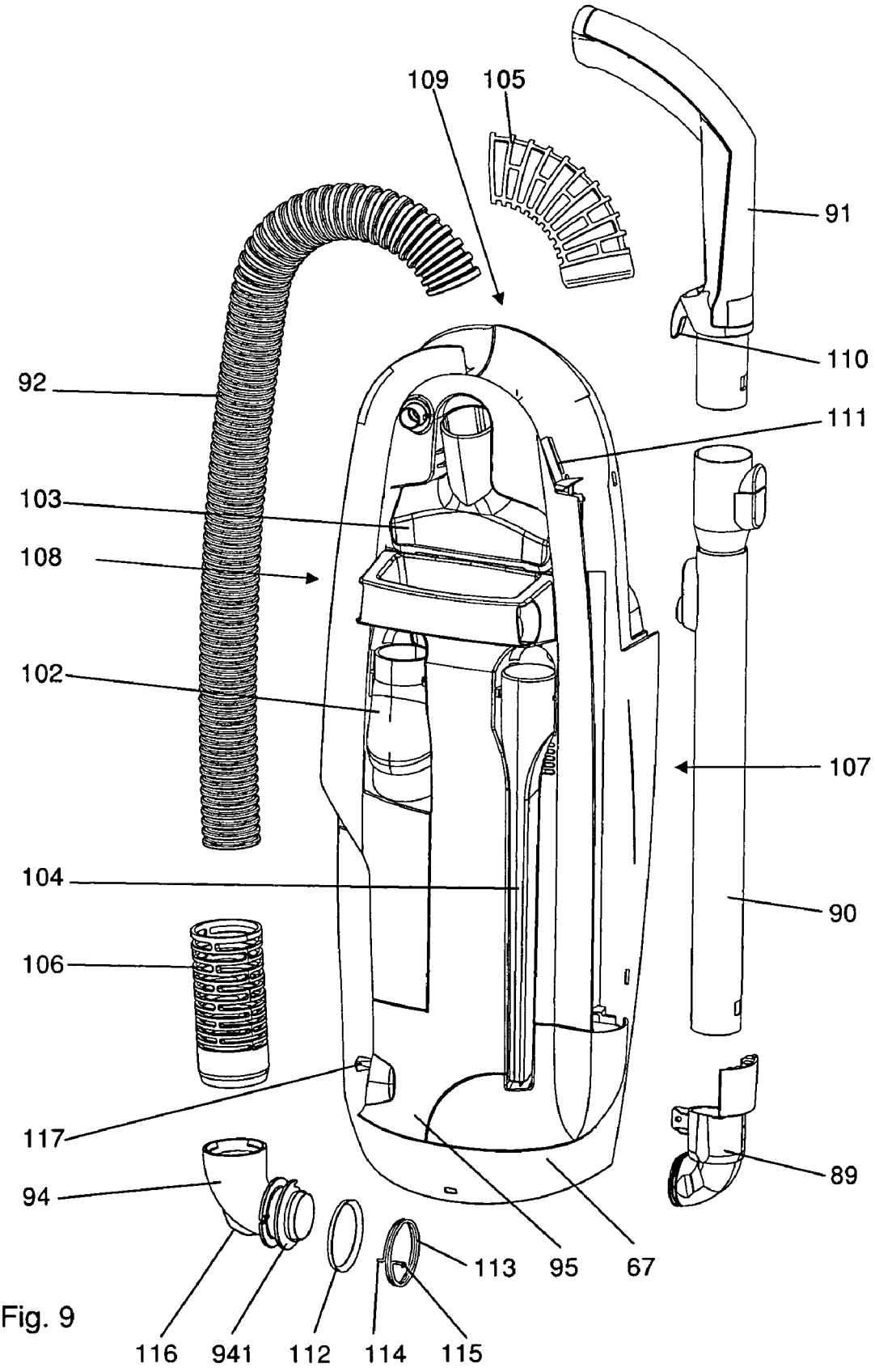
FIG. 9 is a rear view showing the upper body and portions of the air passageway in an exploded view.

The air path portion that enables vacuuming independently of base unit 2 is shown in an exploded view in FIG. 9. Elbow 89 provides the interface at which this portion can be separated. Telescoping wand 90 is inserted in elbow 89 and can be removed therefrom. Telescoping wand 90 is, in turn, detachably secured to wand handle 91. Various vacuum attachments, including a dusting brush 102, an upholstery tool 103 and a crevice tool 104, are secured on the outside of rear wall 67 of the upper body, and may optionally be attached to either telescoping wand 90 or wand handle 91. Wand handle 91 is connected to flexible suction hose 92, the transition region from handle 91 to hose 92 being surrounded by an upper anti-kink sleeve 105. Flexible hose 92 is then connected to swivel elbow 94, this second transition region from hose 92 to swivel elbow 94 being surrounded by a lower anti-kink sleeve 106.

It can be seen from FIGS. 3 and 9 that receiving structure 93, which holds telescoping wand 90, wand handle 91 and hose 92, is U-shaped and extends along nearly the entire length of the two side surfaces 107 and 108 and upper surface 109 of upper body 3. At side surface 108, which is on the left side as viewed in the direction of travel and shown to the left in FIG. 9, only the second transition region, which is formed by swivel elbow 94 and lower anti-kink sleeve 106, is left free. It can be seen both in FIGS. 3 and 9 and in the cross-sectional view of FIG. 10 that receiving structure 93 is recessed into side surfaces 107 and 108 and into upper surface 109. The cross-sectional view of FIG. 10 further illustrates that in the second transition region on left side 108, receiving structure 93 has a cross-section of only a quadrant of a circle. Since receiving structure 93 is arranged in side surfaces 107 and 108 and in upper surface 109 of upright 1, the open side of the receiving structure 93 faces upward and to the left and right sides of upright 1 when it is in the parked position (FIGS. 1 through 3). After completion of a vacuuming operation in a mode that is independent of base unit 2, the user can simply insert telescoping wand 90 into elbow 89. An additional positioning aid is provided by a hook 110 on wand handle 91, which is inserted into an aperture 111 in receiving structure 93. Telescoping wand 90 and wand handle 91 are then received by receiving structure 93 in right side wall 107. In this process, flexible hose 92 lays itself into the portion of receiving structure 93 that faces toward upper surface 109. The remainder of the hose 92 can then be stored in receiving structure 93 at left side wall 108 with a slight pressure from the side. The upper anti-kink sleeve 105 behind wand handle 91 is made from a relatively soft plastic material, such as TPE or PVC, having a hardness between 60 and 70 Shore A, and can therefore be easily pressed into receiving structure 93.

Figure 11A:
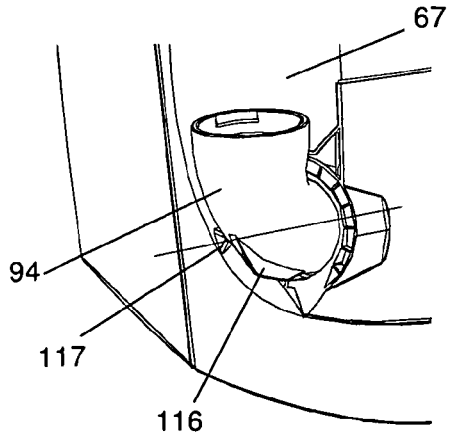
FIGS. 11*a* and 11*b* show the swivel elbow in different views.
Figure 11B:
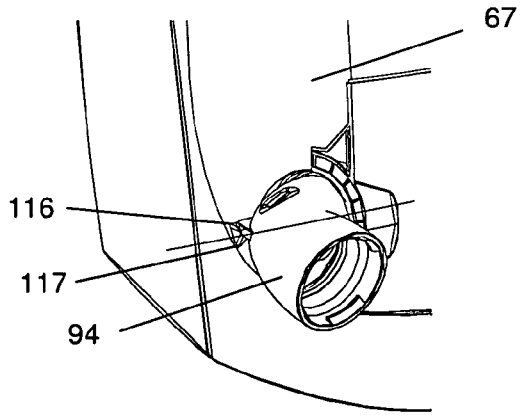

Swivel elbow 94 is rotatably mounted on the inlet of duct 83, which is provided by rear wall 67 and the air duct member 95 placed thereon. Projection 941, which projects into the duct, is surrounded by a seal 112 and a torsion spring 113, one end 114 of which is secured to swivel elbow 94 itself. The other end 115 rests in a guide (not shown) in duct 83. Thus, rotation of swivel elbow 94 from the position shown in FIG. 11*a* to the position shown in FIG. 11*b* is against the force of torsion spring 113. Rotation can be through 110° degrees. In this position, the rib 116 formed on elbow 94 lockingly engages the latching nose 117 of rear wall 67, and elbow 94 is retained in this position until hose 92 is pulled upwardly, releasing the locked engagement. The force of torsion spring 113 is selected such that it allows hose 92 and swivel elbow 94 to swivel relatively freely between the 12 o'clock position (FIG. 11*a*) and the 3 o'clock position and yet assists in the return movement to the 12 o'clock position. To this end, lower anti-kink sleeve 106 must be made from a relatively hard, inflexible material, such as polypropylene. It is only in this way that the unstable flexible hose 92 can be supported and guided. For this purpose, anti-kink sleeve 106 should be at least 14 cm in length.

Figure 12:
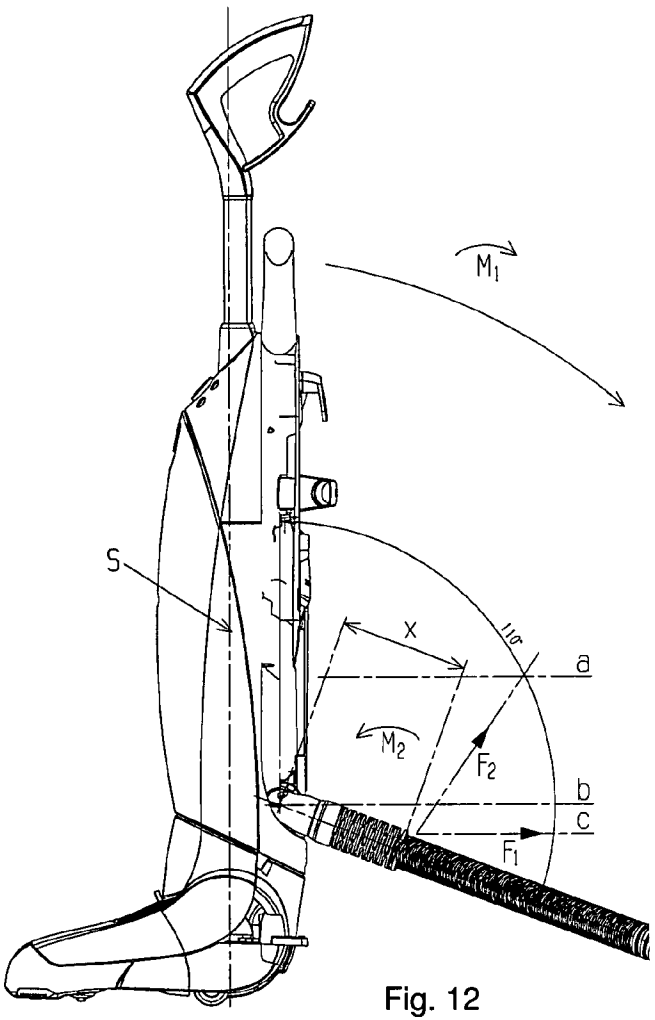
FIG. 12 shows the relationship of forces and moments arising when a pull is exerted on the hose in a direction opposite to the direction of travel.

FIG. 12 shows the relationship of forces arising in a situation where the swivel elbow has been rotated through 110° and locked in position and the user pulls upright 1 behind him/her by hose 92. In this position, swivel elbow 94 and lower anti-kink sleeve 106 act as a lever arm of length X. When pulling horizontally in direction F1, the pulling force acts at a point far below the center of gravity S in very close proximity to the tip-over point defined by the rear wheels (line of force c). Because of this, the overturning moment produced by this force F1 is smaller than in a situation where a pull is exerted on a non-swivel elbow in the 12 o'clock position (line of force a) or on a swivel elbow in the 3 o'clock position (line of force b). When pulling in direction F2, lever arm X produces a moment M2 which even counteracts the overturning moment M1. Accordingly, elbow 94 and its locking engagement means 116 and 117 contribute to the vertical stability of upright 1.

Figure 13:
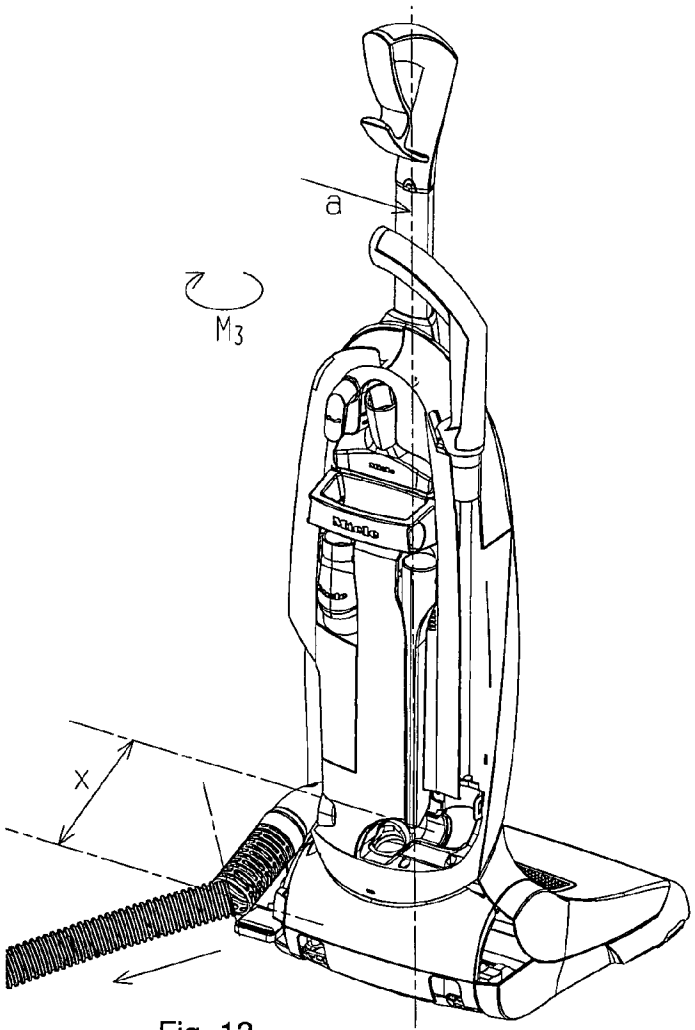
FIG. 13 shows the relationship of forces and moments arising when a pull is exerted on the hose in a direction angular to the direction of travel.

When, as shown in FIG. 13, the user pulls on hose 92 in a direction angular to the direction of travel while swivel elbow 94 is locked in position, then a moment M3 produced by lever arm X acts in a horizontal plane and turns the upright about its vertical axis a until the carriage is oriented in the pulling direction and the horizontal moment M3 disappears. This prevents lateral overturning.

The present invention has been described herein based on one or more exemplary embodiments, but is not limited thereto. Reference should be had to the appended claims.

What is claimed is:

1. An upright vacuum cleaner for cleaning a surface comprising:

a base unit;

a carriage configured to move the base unit on the surface;

an upper body having a dust collection container disposed therein, the upper body being supported so as to be tiltable relative to the base unit and lockable in a parked position in which the vacuum cleaner has a substantially upright position when standing on the surface;

a motor-fan unit configured to provide a partial vacuum at the surface;

an air conduit connecting the base unit and the dust collection container, the air conduit including a section formed by a hose or an assembly of the hose and a wand, the section being at least partially disposed externally on the upper body and being configured to enable a vacuuming mode of operation that is independent of the base unit; and a tubular member forming at least part of a transition between the hose and the upper body, the tubular member being swivelably disposed on the upper body, the tubular member being configured to swivel from an upright position to a rearward pointing position when the upper body is in the parked position and to be lockable in the rearward pointing position.

2. The upright vacuum cleaner as recited in claim 1 wherein the tubular member points in a horizontal direction when in the rearward pointing position.

3. The upright vacuum cleaner as recited in claim 1 wherein the tubular member points in a downward direction when in the rearward pointing position.

4. The upright vacuum cleaner as recited in claim 3 wherein the tubular member is swivelable from a vertical position through a maximum angle of between 100° and 120° when the upper body is in the parked position.

5. The upright vacuum cleaner as recited in claim 1 wherein the tubular member is swivelable from a vertical position through a maximum angle of between 100° and 120° when the upper body is in the parked position.

6. The upright vacuum cleaner as recited in claim 5 wherein the tubular member includes a swivel elbow disposed laterally in a lower portion of the upper body.

7. The upright vacuum cleaner as recited in claim 1 further comprising a spring element operable to act against the swivel to the rearward pointing position.

8. The upright vacuum cleaner as recited in claim 1 wherein the tubular member includes a swivel elbow disposed laterally in a lower portion of the upper body.

9. The upright vacuum cleaner as recited in claim 8 further comprising an anti-kink sleeve circumscribing the hose in a vicinity of the transition.

10. The upright vacuum cleaner as recited in claim 1 further comprising an anti-kink sleeve circumscribing the hose in a vicinity of the transition.

11. The upright vacuum cleaner as recited in claim 1, wherein the air conduit includes an interface in communication with the base unit, the interface being configured to receive the section formed by the hose or assembly of the hose and wand so as to connect the section to the base unit.

* * * * *